US006092741A

United States Patent [19]

Sumida

[11] Patent Number: 6,092,741

[45] Date of Patent: Jul. 25, 2000

[54] FUEL INJECTION VALVE

[75] Inventor: Mamoru Sumida, Tokyo, Japan

[73] Assignee: Mitsubishi Denki Kabushiki Kaisha, Tokyo, Japan

[21] Appl. No.: 09/243,441

[22] Filed: Feb. 3, 1999

[30] Foreign Application Priority Data

Aug. 24, 1998 [JP] Japan ..... 10-237291

[51] Int. Cl.[7] ..... F02M 51/00

[52] U.S. Cl. ..... 239/408; 239/533.12; 239/585.1

[58] Field of Search ..... 239/585.1, 585.3, 239/585.4, 533.12, 407, 408; 123/531

[56] References Cited

U.S. PATENT DOCUMENTS

| | | | |
|---|---|---|---|
| 4,657,189 | 4/1987 | Iwata et al. | 239/585.4 X |
| 4,771,948 | 9/1988 | Furukawa et al. | 239/585.4 X |
| 5,062,573 | 11/1991 | Makimura | 239/533.12 |
| 5,224,458 | 7/1993 | Okada et al. | 239/533.12 X |
| 5,360,166 | 11/1994 | Nogi et al. | 239/585.1 X |
| 5,518,182 | 5/1996 | Sasao | 239/585.4 X |

FOREIGN PATENT DOCUMENTS 7-103100 4/1995 Japan .

*Primary Examiner*—Lesley D. Morris
*Attorney, Agent, or Firm*—Sughrue, Mion, Zinn, Macpeak & Seas, PLLC

[57] ABSTRACT

A fuel injection valve having an adapter 50 molded from resin and mounted to an extreme end of an injection valve main body 1; a plurality of air/fuel mixing passages 51 formed in the adapter 50 at equal pitches about a first center line drawn axially through the fuel injection valve, having passage centers defined from cross-sectional areas of the air/fuel mixing passages 51 which provide second center lines through each of the passage centers; the second center lines intersect at one point on the first center line, the intersection point being positioned on an upper stream side of the adapter 50, each of the passages 51 being disposed at a same angle of inclination with respect to the first center line; air passages 52, formed in the adapter 50 which communicate with the air/fuel mixing passages 51 to introduce air into the passages 51; a plate 24, disposed between the injection valve main body 1 and the adapter 50; and orifice holes 24*a*, formed in the plate 24 to confront openings of the plurality of air/fuel mixing passages in order to distribute the fuel from the injection port to the plurality of air/fuel mixing passages 51, wherein the plurality passages 51 are formed having virtual edge portions at the openings thereof which contact each other, without overlapping, at the upstream end surface of the adapter and wherein a cross section of each of the passages 51 is linearly shaped and approximately parallel with a tangential line of an adjacent virtual edge portion forming a partition wall 53 of prescribed thickness between adjacent passages 51.

5 Claims, 7 Drawing Sheets

FUEL INJECTION VALVE

BACKGROUND OF THE INVENTION

1. Field of the Invention

The present invention relates to an air assist type fuel injection valve disposed to the intake passage of an automobile engine and for supplying fuel into a combustion chamber together with assist air.

2. Description of the Related Art

FIG. 9 is a sectional view showing a conventional fuel injection valve disclosed in, for example, Japanese Unexamined Patent Publication No. 7-103100, FIG. 10 is a partial sectional view showing the main portion of the conventional fuel injection valve shown in FIG. 9 and FIG. 11 is a top view showing an adapter used to the conventional fuel injection valve shown in FIG. 9.

As shown in the respective figures, the fuel injection valve includes an injection valve main body 1 and an adapter 2 mounted to the extreme end of the injection valve main body 1. The injection valve main body 1 includes a valve actuating system, an electromagnetic actuating system and a fuel passage system and these systems are accommodated in a housing 3 formed to a cylindrical shape.

The valve actuating system includes a stopper 4 and a valve seat main body 5 which are disposed from the upper portion to the lower portion of a valve casing section 3*a* formed to the lower portion of the housing 3. An accommodating section 5*a* is formed to the valve seat main body 5 along the center axial line thereof as well as a needle valve 6 is accommodated in the accommodating section 5*a* so as to move in the direction of the axial line of the needle valve 6. An injection port 5*c* communicating with the accommodating section 5*a* is formed to the extreme end surface 5*b* of the valve seat main body 5.

The electromagnetic actuating system includes an armature 7 which clamps the upper end of the needle valve 6, a core 9 disposed in series with the armature 7 through a spring 8, a sleeve 30 disposed internally of the core 9 and a bobbin 11 around which an electromagnetic coil is wound so as to surround the above components. The respective components 7, 8, 9, 30 which constitute the electromagnetic actuating system are accommodated in the upper portion of the housing 3. A collar section 9*a* is formed at a midpoint of the core 9 in the vertical direction thereof and the core 9 is fixed in the housing 3 by caulking the collar section 9*a* by the housing 3. A socket 13 is disposed to the housing 3 to protect a terminal 12 connected to the electromagnetic coil 10 and to fit and connect to another terminal.

The fuel passage system includes a filter 14 mounted on the upper end of the core 9, a first fuel passage 15*a* formed in the sleeve 30 so that the fuel supplied through the filter 14 passes therethrough, a second fuel passage 15*b* formed in the armature 7 along the axial line thereof continuously from the first fuel passage 15*a* and a third fuel passage 15*c* formed between the accommodating section 5*a* of the valve seat main body 5 and the outer periphery of the needle valve 6 continuously from the second fuel passage 15*b*.

The adapter 2 includes two air/fuel mixing passages 19 having a circular cross section into which the fuel injected from the injection port 5*c* of the injection valve main body 1 is introduced and air passages 20 opened to the respective air/fuel mixing passages 19 for supplying air thereinto. The adapter 2 causes the fuel injected into the air/fuel mixing passages 19 to collide against the air from the air passages 20 to thereby make the fuel to fine particles. The two air/fuel mixing passages 19 are formed symmetrically with respect to the center axial line of the injection port 5*c* with the centerlines thereof intersecting at a point on the center axial line of the injection port 5*c*. Further, the edge portions of the openings formed to the upstream end surfaces of the respective air/fuel mixing passages 19 are in contact with each other on the center axial line of the injection port 5*c*.

The fuel injection valve is mounted on a holder 21 which is formed integrally with an intake passage communicating with the combustion chamber of a cylinder. An air introducing nipple 22 is mounted on the holder 21.

An air supply passage 23 is formed between the outer peripheral surface of the adapter 2 and the inner peripheral surface of the holder 21. Air is introduced from the air introducing nipple 22 into the air supply passage 23 and supplied to the respective air/fuel mixing passages 19 through the air supply passage 23 and the respective air passages 20.

A plate 24 is interposed between the extreme end surface 5*b* of the valve seat main body 5 and the adapter 2 in intimate contact with both of them. The plate 24 is fixed in the state that it is in intimate contact with the extreme end surface 5*b* of the valve seat main body 5 and respective parts are made so that the plate 24 comes into intimate contact with the adapter 2 when the adapter 2 is mounted on the injection valve main body 1. Circular orifice holes 24*a* are formed to the plate 24 each opposing each air/fuel mixing passage 19. Therefore, the orifice hole 24*a* is connected directly to the air/fuel mixing passage 19 without interposing a fuel flow divider therebetween. Since the opening 28 of the air passage 20 is formed on each of the air/fuel mixing passages 19 at a position a prescribed distance apart from the end surface of the plate 24 toward a downstream side, the portion of the air/fuel mixing passage 19 located downstream of the opening 28 serves as the air/fuel mixing passage substantially.

As apparent from FIG. 9 and FIG. 10, the total area of the openings of the two orifice holes 24*a* is set smaller than the opening area of a seat section 5d when the needle valve 6 moves in the upward direction to thereby open the valve. As a result, in the fuel injection, a uniform pressure chamber 5e where the pressure of fuel is made uniform is formed in a space on the fuel upstream side of the plate 24. The fuel injection quantity supplied to each respective air/fuel mixing passage 19 is determined by the area of each orifice hole 24*a* which corresponds to each air/fuel mixing passage 19. Accordingly, the same amount of fuel is uniformly supplied to each air/fuel mixing passage 19 from each orifice hole 24*a* having the same diameter. Further, each of the orifice holes 24*a* is formed directing to each of the openings 28 of the air passages 20.

An O-ring 25 is interposed between the lower end of the adapter 2 and the lower end surface of the holder 21 so that they are held in an air tight state.

Next, the operation of the conventional fuel injection valve will be described.

When fuel is supplied to the fuel injecting system, it is filtered with the filter 14 and reaches the seat section 5*d* of the valve seat main body 5 through the first, second and third fuel passages 15*a*, 15*b* and 15*c*.

When the electromagnetic actuating system of the fuel injection valve is actuated, the needle valve 6 is driven and moved upward, the seat section 5*d* of the valve seat main body 5 is opened and the fuel is injected from the injection port 5*c*. Since the uniform pressure chamber 5*e* is filled with the fuel and a uniform pressure is applied to the plate 24 confronting the injection port 5*c* at the time, the fuel is injected into the respective air/fuel mixing passages 19 while being uniformly distributed by the circular orifice holes 24*a* having the same diameter. That is, the flow rates of the fuel to be injected into the respective air/fuel mixing passages 19 are determined by the open areas of the orifice holes 24*a* and, as a result, the fuel is separately supplied into the respective air/fuel mixing passages 19 while being accurately measured by the respective orifice holes 24*a*.

Since the fuel is separately supplied by the orifice holes 24*a* of the plate 24, it can be uniformly injected. Moreover, since the fuel is held once in the uniform pressure chamber 5*e* and then injected into the air/fuel mixing passages 19, the collision of the injected fuel against the air/fuel mixing passages 19 is restricted and thus it is also restricted that the injected fuel drops into an engine cylinder in the form of droplets. On the other hand, assist air is introduced from the air introducing nipple 22 into the air supply passage 23 and supplied into the respective air/fuel mixing passages 19 from a lateral direction through the respective air passages 20. The thus supplied assist air is collided against the fuel supplied from the orifice holes 24*a* to thereby make the fuel to fine particles. The fuel is injected into each combustion chamber in an amount distributed by the orifice holes 24*a*.

In the conventional fuel injection valve arranged as described above, a fuel branch section need not be formed to the adapter 2 because fuel is uniformly divided by the orifice holes 24*a* of the plate 24 and passes through the air/fuel mixing passages 19. Therefore, the adapter 2 can be molded from resin which can be very easily processed as compared with a case that the adapter 2 is composed of metal because it is not required to correctly machine the adapter 2 to flow fuel in an uniformly divided amount.

In the conventional fuel injection valve, however, since the edge portions of the openings formed to the upstream end surfaces of the two air/fuel mixing passages 19 are formed to come into contact with each other on the center axial line of the injection port 5*c*, the partition wall between the two air/fuel mixing passages 19 forms an edge to the upstream end surfaces. As a result, there is a problem that when the adapter 2 is molded from resin, the edge section is chipped off because the resin does not flow well so that the edge is formed to a little short shape and the distribution of fuel is adversely affected thereby.

To improve the problem of the conventional fuel injection valve, there is contemplated a method that the partition wall between the two air/fuel mixing passages 19 does not form an edge to the upstream end surfaces by shifting the positions where the two air/fuel mixing passages 19 are formed toward the outside of the fuel injection valve in a radius direction. In this case, however, the directions in which fuel is injected from the orifice holes 24*a* are greatly displaced from the passage centers of the two air/fuel mixing passages 19 by the shift of the positions where the air/fuel mixing passages 19 are formed toward the outside in the radial direction. Accordingly, there is caused a problem that a mixed gas cannot be formed well.

To cope with the above problem, it is also contemplated to shift the positions where the orifice holes 24*a* are formed toward the outside in the radial direction in accordance with the positions where the air/fuel mixing passages 19 are formed or to increase the inclination of the hole axis (fuel injecting angle) of the orifice holes 24*a*. In these cases, however, there arises a problem that it is difficult to punch many holes to the plate 24 by a press machine and productivity is lowered thereby. Further, the shift of the positions where the orifice holes 24*a* are formed toward the outside in the radius direction increases the volume of a dead space formed upstream of the plate 24. When fuel is not injected, there exists fuel to which no fuel pressure is applied in the dead space and further the amount of the fuel changes by the evaporation of it. Thus, there is a problem that since the amount of fuel in the dead space is greatly dispersed by an increase of the dead space, an amount of fuel to be injected cannot be correctly controlled when the injection of fuel is resumed.

As described above, it is required to a fuel injection valve that the dislocation between the directions in which fuel is injected from the orifice holes 24*a* and the passage centers of the air/fuel mixing passages 19 is suppressed as well as the volume of a dead space is reduced. Further, it is necessary to dispose the openings formed to the upstream end surfaces of the air/fuel mixing passages 19 in close proximity to each other.

SUMMARY OF THE INVENTION

An object of the present invention made to solve the above problems is to provide a fuel injection valve arranged such that a partition wall is disposed between air/fuel mixing passages formed in an adapter molded from resin to partition the upstream end surfaces of the passages, the openings formed to the upstream end surfaces of the air/fuel mixing passages are disposed in close proximity to each other while improving the molding property of the adapter and the distributing property of fuel and the flexibility of the fuel injection valve to a mounting position and direction is improved.

Another object of the present invention is to provide an air assist type fuel injection valve for injecting fuel in many directions capable of stably supplying fuel to respective air/fuel mixing passages in a uniform flow rate even if a fuel branch section does not have an accurate shape and size and preventing the deterioration of exhaust gases caused by the deposit of droplets to an adapter.

In order to achieve the above objects, according to one aspect of the present invention, there is provided a fuel injection valve which includes an injection valve main body having an injection port for injecting fuel; an adapter molded from resin and mounted to the extreme end of the injection valve main body; a plurality of air/fuel mixing passages formed to the adapter about the axial center thereof at equal pitches so that they have an approximately circular or oval cross sectional shape, the passage centers of the air/fuel mixing passages intersect at one point on the axial center on an upper stream side at the same inclining angle with respect to the axial center and the air/fuel mixing passages cause the fuel from the injection port to pass therethrough; air passages formed to the adapter so as to communicate with the air/fuel mixing passages and introduce air into the air/fuel mixing passages; a plate disposed to shut off the portion between the injection valve main body and the adapter; and orifice holes formed to the plate so as to confront the openings of the plurality of air/fuel mixing passages formed on the upstream side thereof and distributing the fuel from the injection port to the plurality of air/fuel mixing passages, wherein the plurality of air/fuel mixing passages are formed such that the virtual edge portions of the openings thereof are approximately in contact with each other on the upstream end surface of the adapter as well as a part of the cross sectional shape of each of the air/fuel mixing passages on the upstream end sides thereof is changed to linear shape which is approximately in parallel with the tangential line of the virtual edge portions of the openings which are adjacent to each other so as to form a partition wall having a prescribed thickness between the air/fuel mixing passages which are adjacent to each other.

DETAILED DESCRIPTION OF THE PREFERRED EMBODIMENTS

Embodiments of the present invention will be described below with reference to the drawings.

Embodiment 1.

Figure 1:
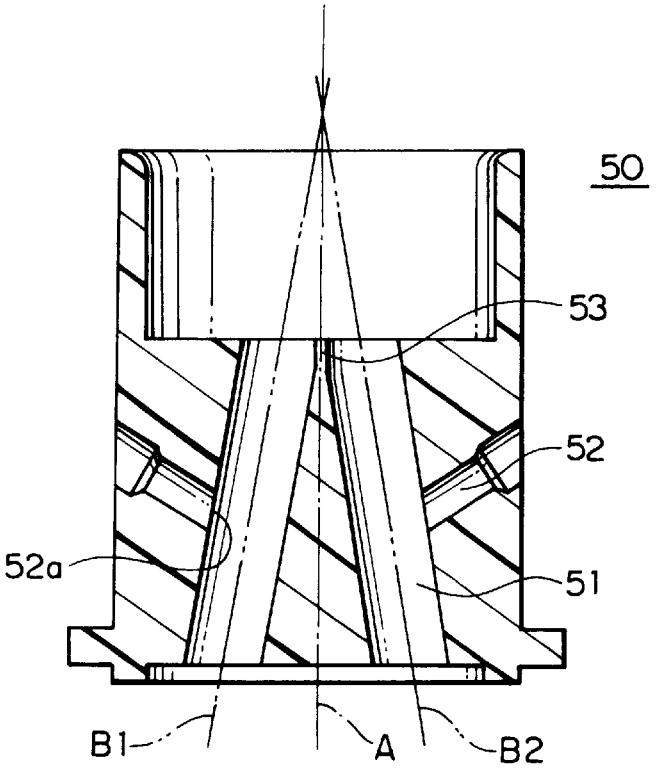
FIG. 1 is a sectional view showing an adapter applied to a fuel injection valve according to an embodiment 1 of the present invention.
Figure 2:
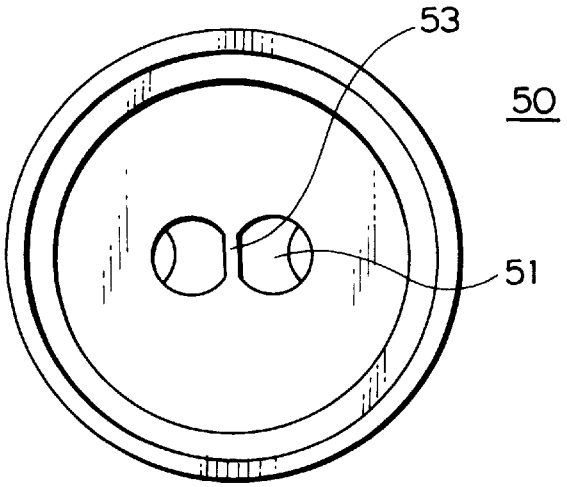
FIG. 2 is a top view showing the adapter applied to the fuel injection valve according to the embodiment 1 of the present invention.
Figure 3:
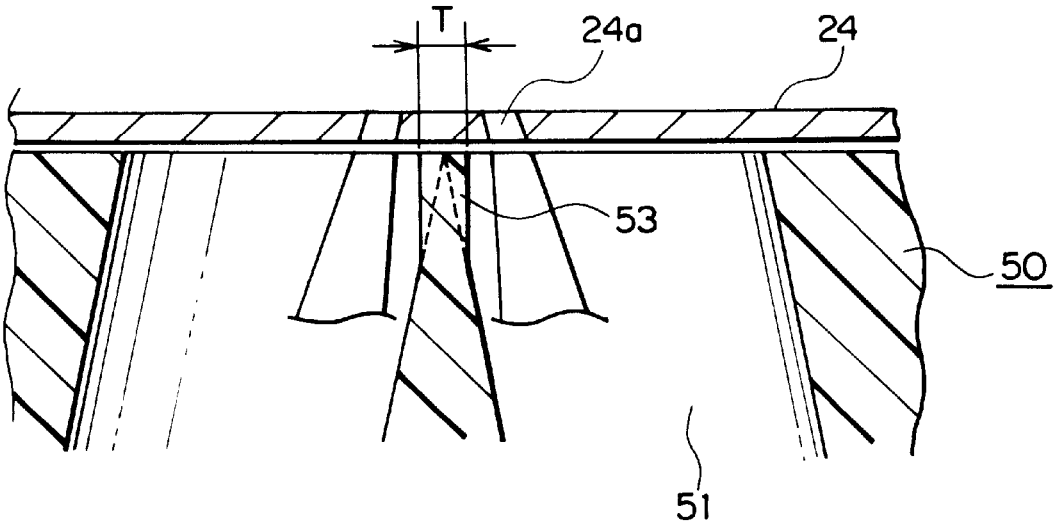
FIG. 3 is a sectional view showing the main portion around the adapter of the fuel injection valve according to the embodiment 1 of the present invention.

FIG. 1 and FIG. 2 are a sectional view and a top view showing an adapter applied to a fuel injection valve according to an embodiment 1 of the present invention, respectively and FIG. 3 is a sectional view showing the main portion around the adapter of the fuel injection valve according to the embodiment 1 of the present invention.

In the respective figures, an adapter 50 is molded from resin and includes two air/fuel mixing passages 51 and air passages 52 opened to the air/fuel mixing passages 51, respectively for supplying air into the air/fuel mixing passages 51.

The two air/fuel mixing passages 51 are formed to have a circular cross section except an upstream end formed to a D-shaped cross section. A partition wall 53 having a thickness T is formed between the air/fuel mixing passages 51 along the upstream ends thereof. The edge portions of the opening (virtual edge portions of the openings) of the air/fuel mixing passages 51 which are virtually formed to the upstream end surface of the adapter by extending the circular cross sectional portions of the two air/fuel mixing passages 51 are in contact with each other on the upstream end surface as shown by the dotted line in FIG. 3. Further, the passage centerlines B1, B2 of the two air/fuel mixing passages 51 intersect at a point on the axial center A of the adapter 50 on the upstream side thereof. In addition, the two air/fuel mixing passages 51 are in a symmetrical relationship of 180° about the axial center A.

Figure 4:
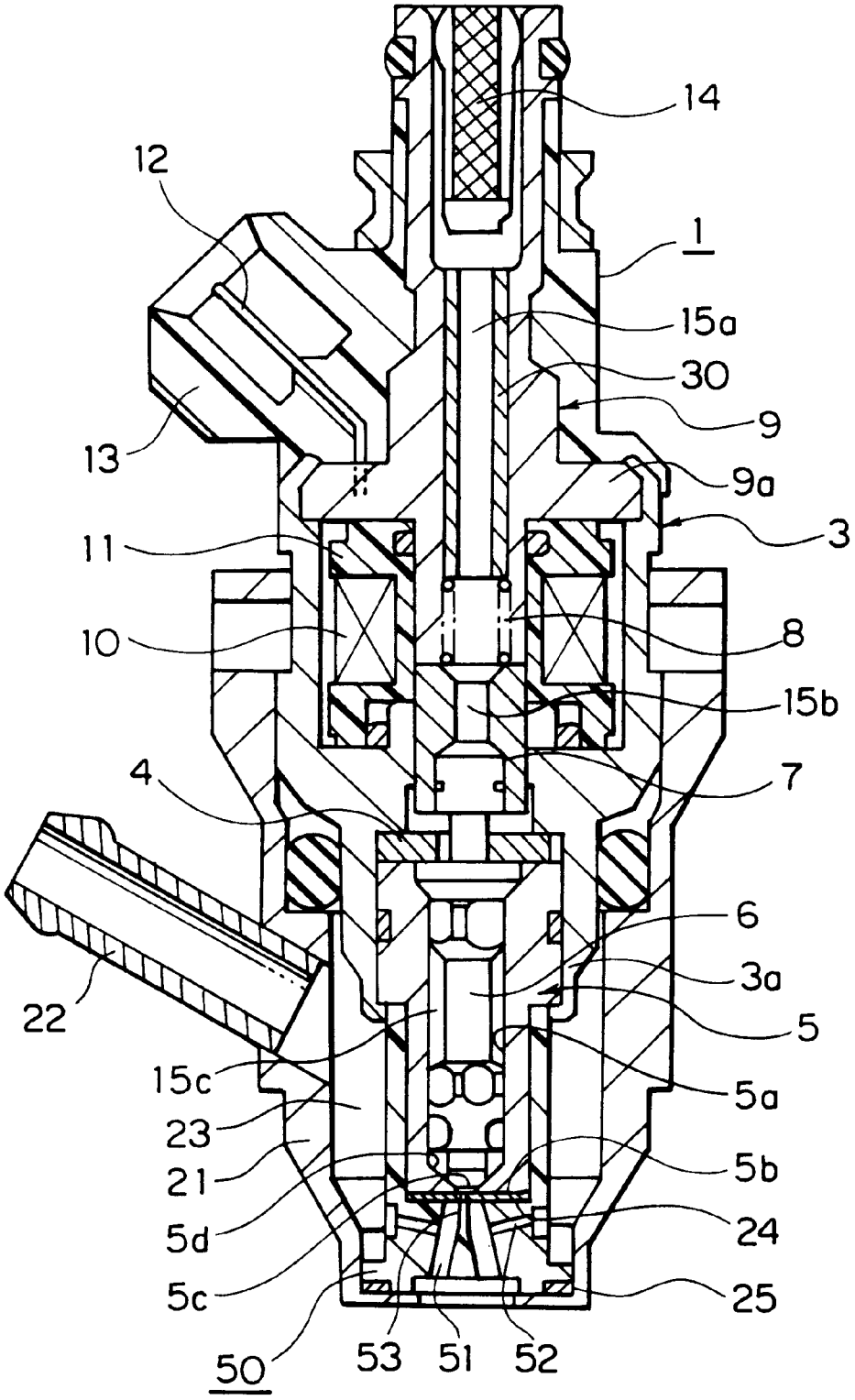
FIG. 4 is a sectional view showing the fuel injection valve according to the embodiment 1 of the present invention.

The adapter 50 arranged as described above is mounted to the extreme end of an injection valve main body 1 so that the axial center A matches the hole center of an injection port 5*c* to thereby constitute a fuel injection valve as shown in FIG. 4. A plate 24 is interposed between the extreme end surface 5*b* of a valve seat main body 5 and the adapter 50. Circular orifice holes 24*a* are formed to the plate 24 each opposing each air/fuel mixing passage 51. Each of the orifice holes 24*a* is formed directing to each of the openings 52*a* of the air passages 52. Since the opening 52*a* of the air passage 52 is formed on each of the air/fuel mixing passages 51 at a position a prescribed distance apart from the end surface of the plate 24 toward a downstream side, the portion of the air/fuel mixing passage 51 located downstream of the opening 52*a* serves substantially as the air/fuel mixing passage 51.

Figure 9:
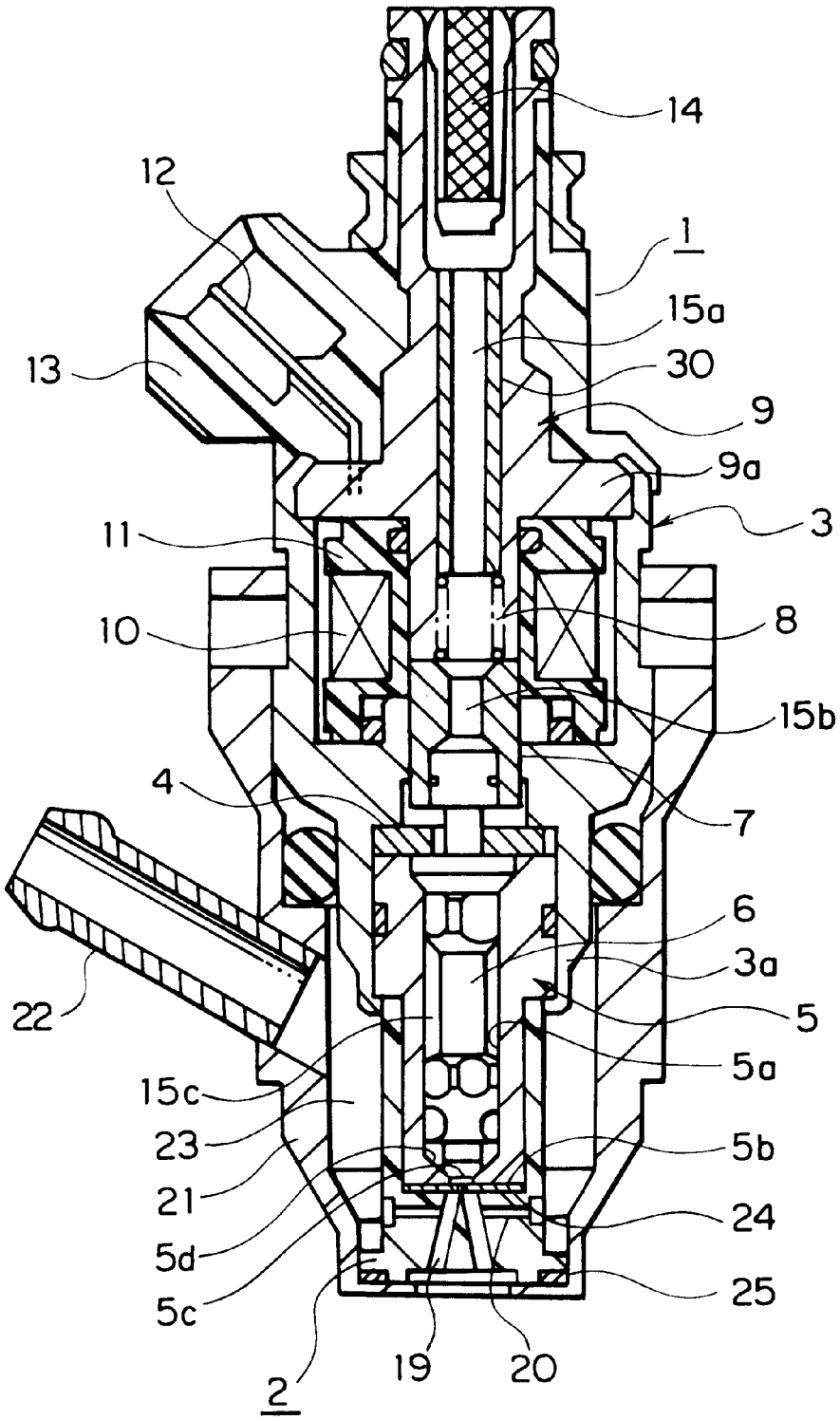
FIG. 9 PRIOR ART
FIG. 9 is a sectional view showing a conventional fuel injection valve.
Figure 10:
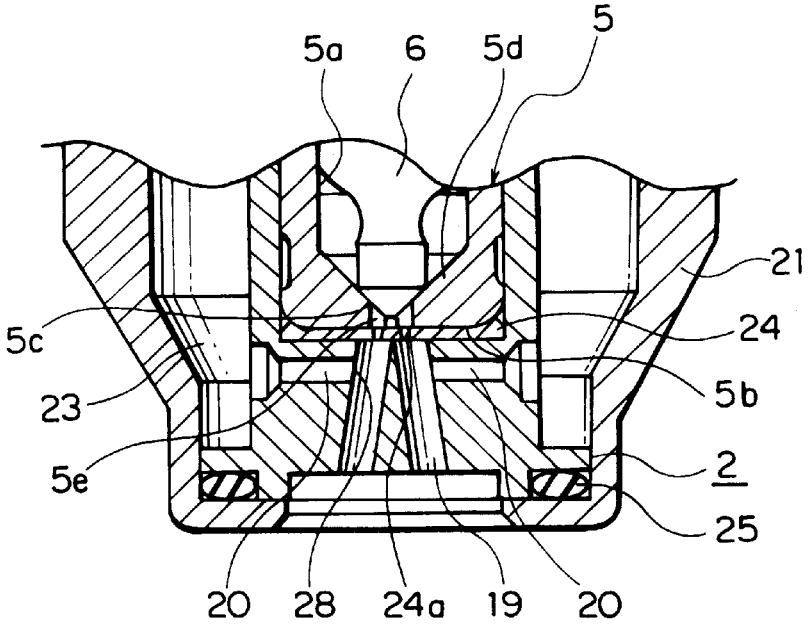
FIG. 10 PRIOR ART
FIG. 10 is a partial sectional view showing the main portion of the conventional fuel injection valve.
Figure 11:
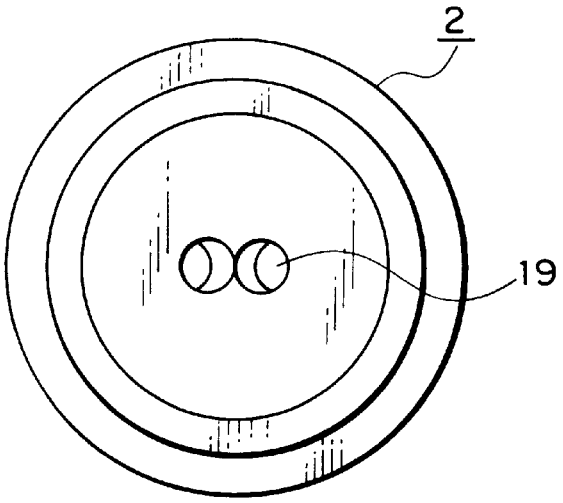
FIG. 11 PRIOR ART
FIG. 11 is a top view showing an adapter used to the conventional fuel injection valve.

The fuel injection valve of the embodiment 1 is arranged similarly to the fuel injection valve shown in FIG. 9 except the above arrangement.

Next, the operation of the fuel injection valve arranged as described above will be described.

When fuel is supplied to a fuel injecting system, it is filtered with a filter 14 and reaches the seat section 5*d* of a valve seat main body 5 through first, second and third fuel passages 15*a*, 15*b* and 15*c*.

When the electromagnetic actuating system of the fuel injection valve is actuated, a needle valve 6 is driven and moved upward, the seat section 5*d* of the valve seat main body 5 is opened and the fuel is injected from the injection port 5*c*. Since a uniform pressure chamber 5*e* is filled with the fuel and a uniform pressure is applied to the plate 24 confronting the injection port 5*c* at the time, the fuel is injected into the respective air/fuel mixing passages 51 while being uniformly distributed by the circular orifice holes 24*a* having the same diameter. That is, the flow rates of the fuel to be injected into the respective air/fuel mixing passages 51 are determined by the open areas of the orifice holes 24*a* and, as a result, the fuel is separately supplied into the respective air/fuel mixing passages 51 while being accurately measured by the respective orifice holes 24*a*.

Since the fuel is separately supplied by the orifice holes 24*a* of the plate 24, it can be uniformly injected. Moreover, since the fuel is held once in the uniform pressure chamber 5*e* and then injected into the air/fuel mixing passages 51, the collision of the injected fuel against the air/fuel mixing passages 51 is restricted and thus it is also restricted that the injected fuel drops into an engine cylinder in the form of droplets. On the other hand, assist air is introduced from an air introducing nipple 22 into an air supply passage 23 and supplied into the respective air/fuel mixing passages 51 from a lateral direction through the respective air passages 52. The thus supplied assist air is collided against the fuel supplied from the orifice holes 24*a* to thereby make the fuel to fine particles. The fuel is injected into the respective combustion chambers in the amounts distributed by the orifice holes 24*a*.

According to the embodiment 1, since the partition wall 53 is formed between the air/fuel mixing passages 51 on the upstream end surface sides thereof, the adapter 50 can be simply molded from resin with no short generated to the upstream ends between the two air/fuel mixing passages 51. Accordingly, the fuel distributing property of the adapter 50 can be secured and fuel passes through the air/fuel mixing passages 51 while maintaining the state that it is uniformly distributed by the orifice holes 24*a* of the plate 24.

Since the upper ends of the two air/fuel mixing passages 51 are formed to have the D-shaped cross section, the air/fuel mixing passages 51 can be formed so that the virtual edge portions of the openings located to the upstream end surfaces of the two air/fuel mixing passages 51 are in contact with each other. That is, the openings formed to the upstream end surfaces of the air/fuel mixing passages 51 can be disposed in close proximity to each other, whereby the flexibility of the fuel injection valve to a mounting position and direction can be improved.

Further, since the openings formed to the upstream end surfaces of the air/fuel mixing passages 51 are disposed in close proximity to each other, the displacement between the direction in which fuel is injected from the orifice holes 24*a* and the passage centers of the air/fuel mixing passages 51 is suppressed and a mixed gas can be stably formed thereby. Since the positions of the orifice holes 24*a* need not be shifted toward the outside in a radial direction in accordance with the positions of the air/fuel mixing passages 51 or the inclination of the hole axis (fuel injection angle) of the orifice holes 24*a* need not be increased, many holes can be easily punched to the plate 24 by a press machine, whereby productivity can be improved. In addition, since the positions of the orifice holes 24*a* need not be shifted toward the outside in the radius direction, the volume of a dead space formed upstream of the plate 24 is not increased and an amount of injected fuel can be correctly controlled thereby.

It is preferable to set the thickness T of the partition wall 53 to at least 0.25 mm from the view point of suppressing the short which is generated to the upstream ends between the air/fuel mixing passages 51 when the adapter 50 is molded from resin. The upper limit of the thickness T of the partition wall 53 may be set in consideration of the tolerances of the plate 24 and the adapter 50 so that an injected flow rate, injection pattern and fuel distribution are not affected by the thickness, that is, the fuel injected from the orifice holes 24*a* is not directly applied to the end surface of the partition wall 53.

Embodiment 2.

Figure 5:
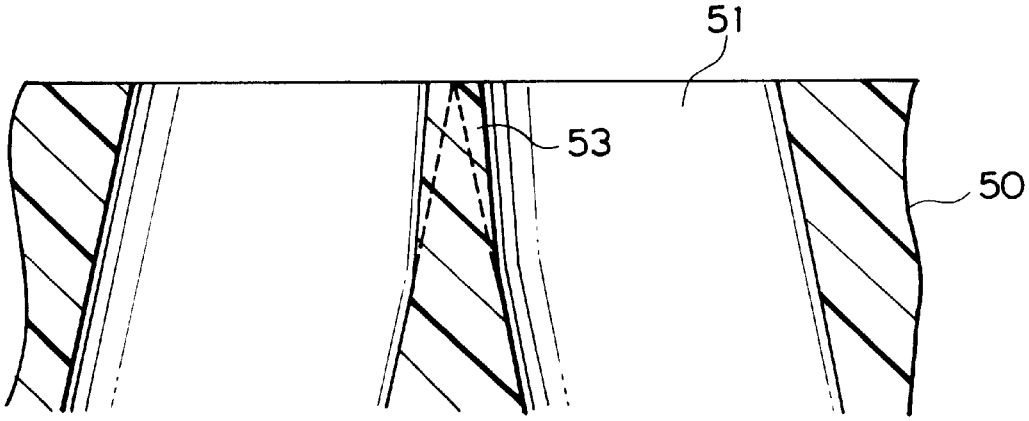
FIG. 5 is a sectional view showing the main portion of an adapter applied to a fuel injection valve according to an embodiment 2 of the present invention.
Figure 6:
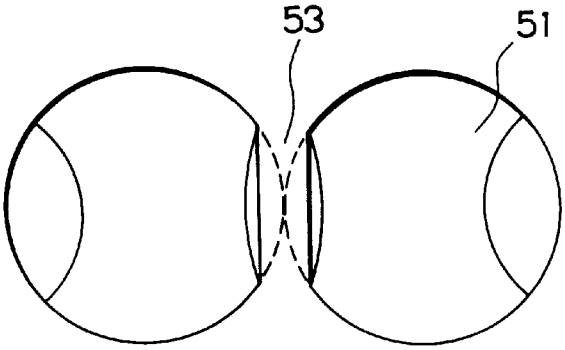
FIG. 6 is a top view showing the main portion of the adapter applied to the fuel injection valve according to the embodiment 2 of the present invention.

In the embodiment 1, the partition wall 53 is coupled with the circular cross sectional portions of the air/fuel mixing passages 51 with its thickness uniformly formed from the upstream end surfaces toward a downstream side. In an embodiment 2, however, a partition wall 53 is coupled with the circular cross sectional portions of air/fuel mixing passages 51 with its thickness gradually increasing from upstream end surfaces toward a downstream side as shown in FIG. 5 and FIG. 6. With this arrangement, there can be obtained the same advantage as that of the embodiment 1.

Embodiment 3.

Figure 7:
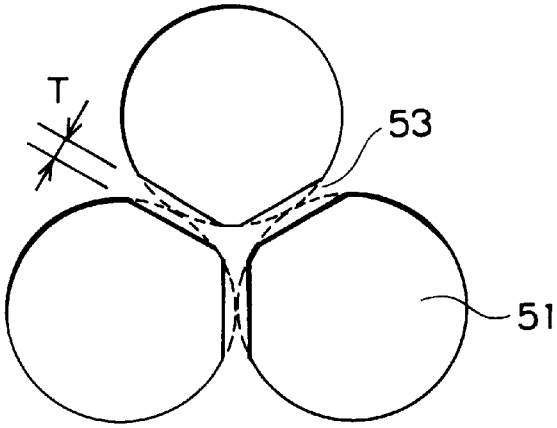
FIG. 7 is a top view showing the main portion of an adapter applied to a fuel injection valve according to an embodiment 3 of the present invention.

In an embodiment 3, three air/fuel mixing passages 51 are disposed to an adapter as shown in FIG. 7.

More specifically, the three air/fuel mixing passages 51 are formed to have a circular cross section except an upstream end formed to an approximately D-shaped cross section and a partition wall 53 having a thickness T is formed to the upper ends between the air/fuel mixing passages 51. As shown by the dotted lines in FIG. 7, the virtual edge portions of the openings located on the upstream end surfaces of the three air/fuel mixing passages 51 are in contact with each other on the upstream end surfaces. The passage center lines of the three air/fuel mixing passages 51 intersect at a point on the axial center of the adapter on the upstream side of the adapter. Further, the three air/fuel mixing passages 51 are in a symmetrical relationship of 120° about the axial center of the adapter.

The thickness of a partition wall 53 is set to 0.25 mm or more and less than a thickness by which an injected amount, injection pattern and fuel distribution are not affected.

With this arrangement, there can be obtained the same advantage as that of the embodiment 1 also in the third embodiment because the openings of the three partition wall 53 on the upstream side thereof are disposed in close proximity to each other.

Embodiment 4.

Figure 8:
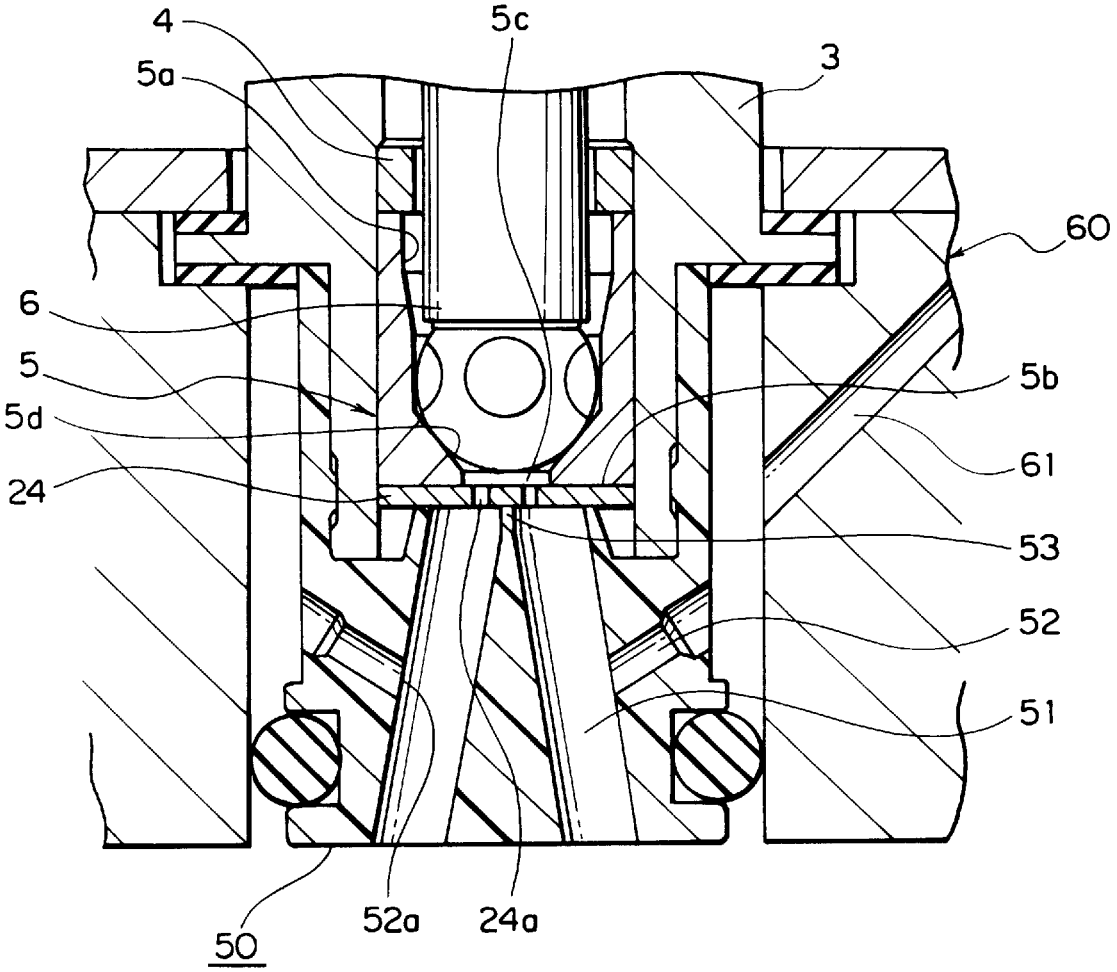
FIG. 8 is a sectional view of a main portion showing how a fuel injection valve according to an embodiment 4 of the present invention is mounted.

FIG. 8 is a sectional view of a main portion showing how a fuel injection valve according to an embodiment 4 of the present invention is mounted.

In FIG. 8, a stopper 4 and a valve seat main body 5 are disposed to the lower portion of the housing 3 of a injection main body and a needle valve 6 is accommodated in the accommodating section 5*a* of the valve seat main body 5 so as to move in an axial center direction. An adapter 50 is mounted to the extreme end of the housing 3 so that the axial center thereof matches the hole center of an injection port 5*c*. A plate 24 is interposed between the extreme end surface 5*b* of the valve seat main body 5 and the adapter 50. Circular orifice holes 24*a* are formed to the plate 24 each opposing each air/fuel mixing passage 51. Each of the respective orifice holes 24*a* is formed directing to each of the openings 52*a* of air passages 52.

The fuel injection valve arranged as described above is directly mounted on an intake manifold 60. An air introducing passage 61 is disposed to the intake manifold 60 and air is supplied to the air/fuel mixing passages 51 through an air introducing passage 61 and the air passages 52.

The embodiment 4 is arranged similarly to the embodiment 1 except that the fuel injection valve is directly mounted on the intake manifold 60.

Accordingly, the same advantage as that of the embodiment 1 can be also obtained in the embodiment 4.

Although the fuel injection valve is directly mounted on the intake manifold 60 in the embodiment 4, the same advantage can be obtained even if the fuel injection valve is directly mounted on a cylinder head.

The cross section of the main passage of the air/fuel mixing passages 51 (portion except the upstream end side) is formed to the circle in the respective embodiments. However, the cross section of the main passage is not limited thereto and may be formed to, for example, an oval (ellipse). Likewise, the cross section of the orifice holes 24*a* is not limited to the circle.

Although one orifice hole 24*a* confronts one air/fuel mixing passage 51 in the above respective embodiments, two or more orifice holes 24*a* may confront one air/fuel mixing passages 51.

Although the above respective embodiments are applied to the fuel injection valve which injects fuel in two or three directions, the same advantage can be obtained even if they are applied to a fuel injection valve having four or more air/fuel mixing passages 51 for injecting fuel in many directions. In this case, it is sufficient that the passage center lines of the respective air/fuel mixing passages 51 intersect at one point on the axial center of the adapter on the upstream side thereof as well as the respective air/fuel mixing passages 51 are formed at an equal angular pitch about the axial enter of the adapter.

In the above respective embodiment, the virtual edge portions of the openings are in contact with each other on the upper stream ends of the air/fuel mixing passages 51. However, they need not be in contact with each other and may be roughly in contact with each other.

Although the orifice holes 24*a* are formed to the plate in the above respective embodiments, the plate may be formed integrally with the valve seat main body 5 and the orifice holes may be formed to the valve seat main body.

Further, it is needless to say that the present invention can be applied to any type of fuel injection valves so long as they are a fuel injection valve arranged such that the fuel injected from an injection port passes through the air/fuel mixing passages 51 after it is distributed by the orifice holes 24*a* disposed to the plate 24.

Since the present invention is arranged as described above, it can achieve the following advantages.

According to the present invention, in a fuel injection valve which includes an injection valve main body having an injection port for injecting fuel; an adapter molded from resin and mounted to the extreme end of the injection valve main body; a plurality of air/fuel mixing passages formed to the adapter about the axial center thereof at equal pitches so that they have an approximately circular or oval cross sectional shape, the passage centers of the air/fuel mixing passages intersect at one point on the axial center on an upper stream side at the same inclining angle with respect to the axial center and the air/fuel mixing passages cause the fuel from the injection port to pass therethrough; air passages formed to the adapter so as to communicate with the air/fuel mixing passages and introduce air into the air/fuel mixing passages; a plate disposed to shut off the portion between the injection valve main body and the adapter; and orifice holes formed to the plate so as to confront the openings of the plurality of air/fuel mixing passages formed on the upstream side thereof and distributing the fuel from the injection port to the plurality of air/fuel mixing passages, the plurality of air/fuel mixing passages are formed such that the virtual edge portions of the openings thereof are approximately in contact with each other on the upstream end surface of the adapter as well as a part of the cross sectional shape of each of the air/fuel mixing passages on the upstream end sides thereof is changed to linear shape which is approximately in parallel with the tangential line of the virtual edge portions of the openings which are adjacent to each other so as to form a partition wall having a prescribed thickness between the adjacent air/fuel mixing passages. Accordingly, there can be provided a fuel injection valve by which the molding property of an adapter can be improved while securing a fuel distributing property as well as the flexibility of the fuel injection valve to a mounting position and direction can be improved.

Further, since the thickness of the partition wall is set to at least 0.25 mm, the occurrence of short at the upstream end between the adjacent air/fuel mixing passages can be suppressed, whereby an excellent fuel distributing property can be obtained.

What is claimed is:

1. A fuel injection valve, comprising:

an injection valve main body having an injection port which injects fuel;

an adapter, molded from resin and mounted to an extreme end of said injection valve main body;

a plurality of air/fuel mixing passages formed in said adapter at equal pitches about a first center line drawn axially through said fuel injection valve, having passage centers defined from cross-sectional areas of said air/fuel mixing passages which provide second center lines through each of the passage centers; said second center lines intersecting at one point on the first center line, said intersection point being positioned on an upstream side of said adapter, each of said passages being disposed at a same angle of inclination with respect to the first center line, said air/fuel mixing passages causing the fuel from the injection port to pass therethrough;

air passages, formed in said adapter which communicate with said air/fuel mixing passages to introduce air into said air/fuel mixing passages;

a plate, disposed between said injection valve main body and said adapter; and orifice holes, formed in said plate to confront openings of said plurality of air/fuel mixing passages in order to distribute the fuel from the injection port to said plurality of air/fuel mixing passages, wherein said plurality of air/fuel mixing passages are formed having virtual edge portions at the openings thereof which contact each other, without overlapping, at the upstream end surface of said adapter and wherein a cross section of each of said air/fuel mixing passages is linearly shaped and approximately parallel with a tangential line of an adjacent virtual edge portion forming a partition wall having a prescribed thickness between adjacent air/fuel mixing passages.

2. A fuel injection valve according to claim 1, wherein the thickness of the partition wall is at least 0.25 mm.

3. The fuel injection valve according to claim 1, wherein said air/fuel mixing passages have an approximately circular or oval cross-sectional shape.

4. A molded adapter for use in a fuel injection system, comprising:

a plurality of air/fuel mixing passages, formed at equal pitch angles about a first center line drawn axially through a fuel injection valve, each of said passages further being disposed at a same angle of inclination with respect to the first center line, wherein the incline angle is defined by second center lines which are drawn through a center point of a cross-sectional plane of each passage and intersect the first center line at a single point on fuel injection valve side of said adapter, thereby creating virtual edge portions on a surface of said adapter in close proximity to an injection port which contact each other; and air passages which communicate with said air/fuel mixing passages to introduce air into said air/fuel mixing passages.

5. The molded adapter according to claim 4, wherein said air/fuel mixing passages have an approximately circular or oval cross-sectional shape.

* * * * *